US006120419A

United States Patent [19]

Huang

[11] Patent Number: 6,120,419

[45] Date of Patent: Sep. 19, 2000

[54] MULTIFUNCTIONAL EXERCISE MACHINE

[75] Inventor: Ching-Chu Hsu Huang, Taichung Hsien, Taiwan

[73] Assignee: How Jing Industrial Company, Ltd., Taichung Hsien, Taiwan

[21] Appl. No.: 09/128,109

[22] Filed: Aug. 3, 1998

[51] Int. Cl.[7] ..... A67B 21/068

[52] U.S. Cl. ..... 482/96; 482/138

[58] Field of Search ..... 481/72, 95, 96, 481/138; D21/673, 674; 482/100, 137

[56] References Cited

U.S. PATENT DOCUMENTS 5,330,405 7/1994 Habing et al. ..... 482/96

5,722,918 3/1998 Lee ..... 482/72

*Primary Examiner*—John Mulcahy

*Attorney, Agent, or Firm*—Harrison & Egbert

[57] ABSTRACT

The multifunctional exercise machine includes a pedal, handle and swivel rod linked to a pivoting seat by a cable and pulley system. The handle is pivotally fastened to a suspension frame rod which is, in turn, pivotally fastened to the frame of the machine. The pedal is pivotally mounted to the frame and the swivel rod is pivotally mounted to the pivoting seat. A cable is fastened at one end to the handle, extends in turn though pulleys on the suspension frame rod, seat suspension rod, pedal and seat suspension rod, again, and is fastened at the other end to the swivel rod. The user faces forward to use the pedal and rearward to use the swivel rod. Movement of the pedal, handle or swivel rod is resisted by the weight of the user on the seat. The machine is foldable to facilitate storage and shipping.

9 Claims, 8 Drawing Sheets

MULTIFUNCTIONAL EXERCISE MACHINE

FIELD OF THE INVENTION

The present invention relates generally to an exercise machine, and more particularly to a multifunctional exercise machine.

BACKGROUND OF THE INVENTION

The conventional multifunctional exercise machine is generally cumbersome and takes up a large floor space. As a result, the conventional multifunctional exercise machine is not suitable for use in a private home in which an available floor space is often quite limited. In addition, the conventional multifunctional exercise machine is rather complicated in construction and expensive. Moreover, the conventional multifunctional exercise machine is generally not foldable to facilitate the storage and the shipping of the machine.

SUMMARY OF THE INVENTION

The primary objective of the present invention is therefore to provide a multifunctional exercise machine free from the drawbacks of the conventional multifunctional exercise machine described above.

The objective, functions, features, and advantages of the present invention will be readily understood upon a thoughtful deliberation of the following detailed description of the present invention with reference to the accompanying drawings.

DETAILED DESCRIPTION OF THE INVENTION

Figure 1:
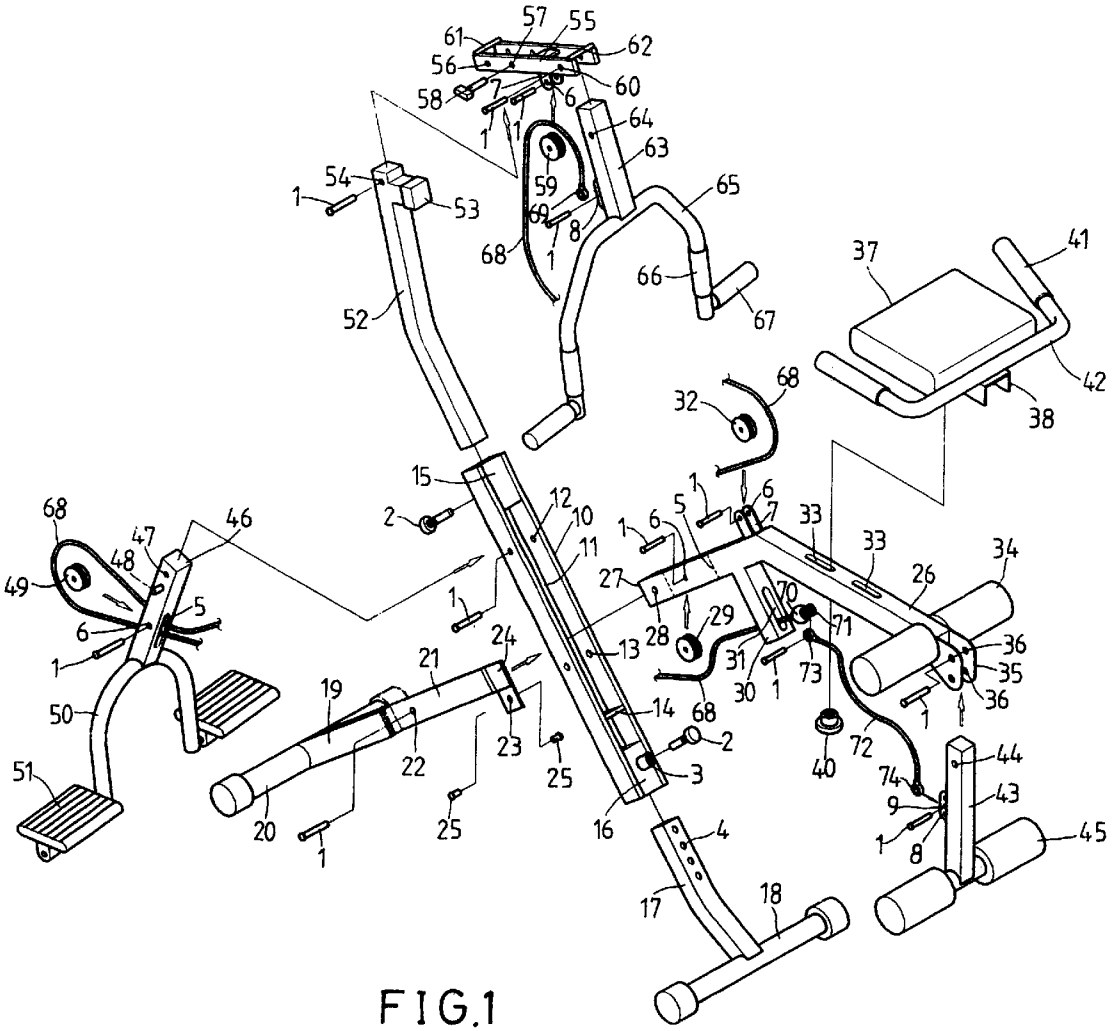
FIG. 1 shows an exploded view of the present invention with the front inclined leg rod 19 shown partially in section.
Figure 2:
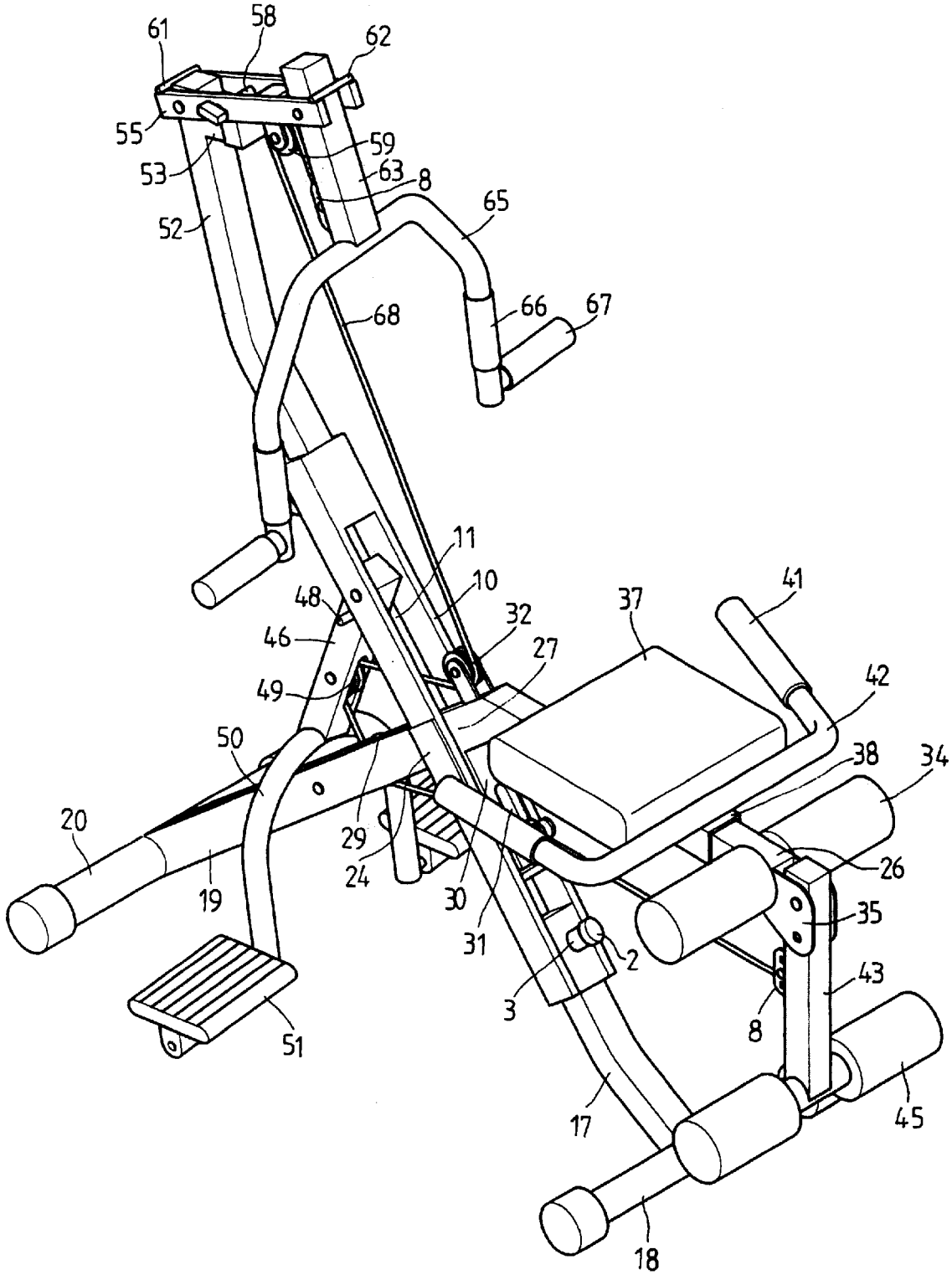
FIG. 2 shows a perspective view of the present invention in combination.
Figure 3:
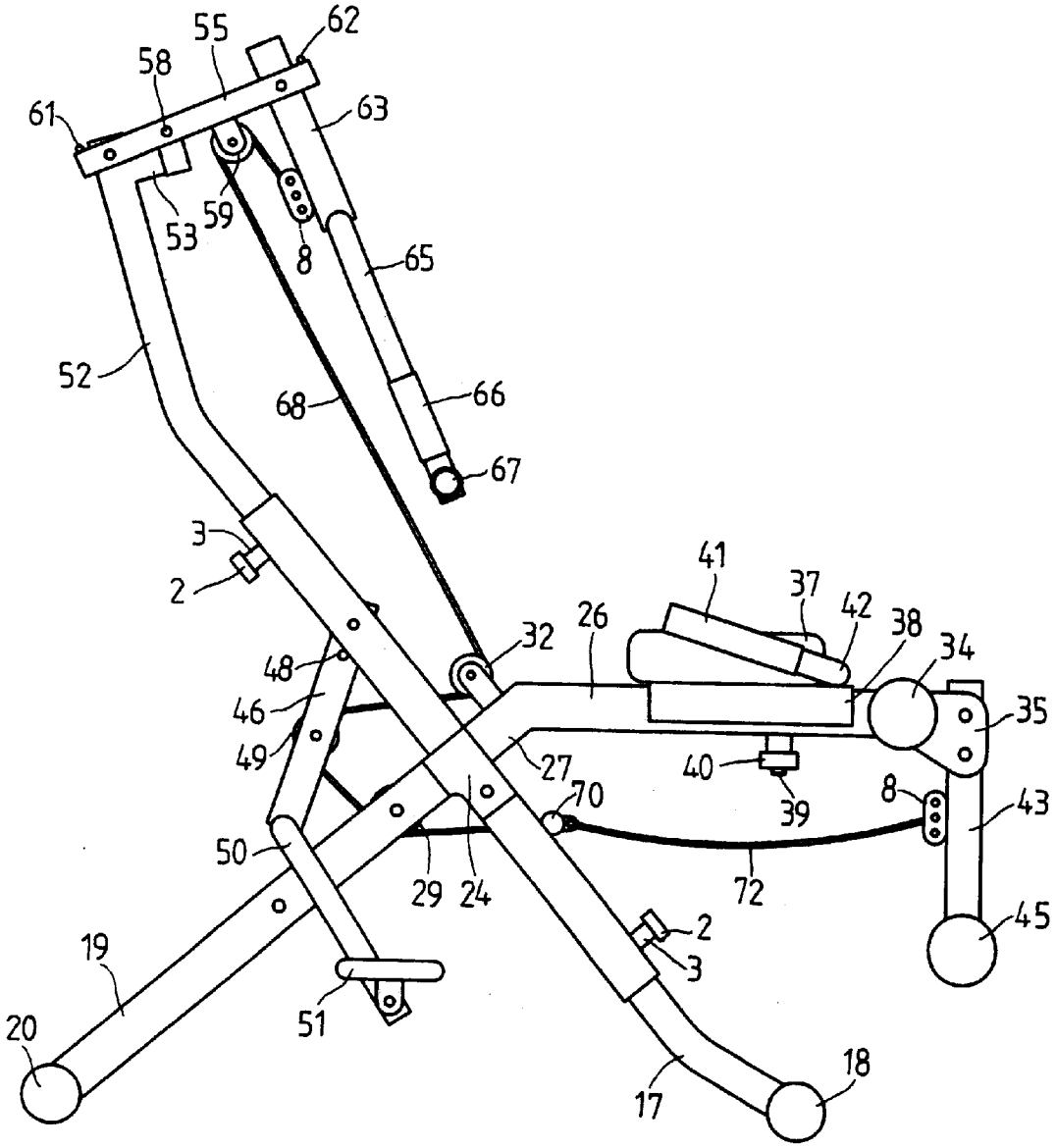
FIG. 3 shows a side view of the present invention.

As shown in all drawings provided herewith, a multifunctional exercise machine embodied in the present invention is composed of the component parts which are described hereinafter.

A rear inclined frame rod 10 is provided with a slot 11 having two support holes 12 opposite in location to each other, two rod holes 13 opposite in location to each other, a rib support plate 14, a top rod fitting seat 15, and a leg rod fitting seat 16. The top rod fitting seat 15 and a leg rod fitting seat 16 are respectively provided with a threaded hole 3 which is engaged with a bolt 2.

A rear inclined leg rod 17 is fastened at the bottom end thereof with a cross rod 18 and is provided at an upper end thereof with a plurality of support holes 4 corresponding in location to the threaded hole 3. The upper end of the rear inclined leg rod 17 is inserted into the leg rod fitting seat 16.

A front inclined frame rod 19 is fastened at the bottom end thereof with a cross rod 20 and is provided with a slot 21 having two support holes 22, and two suspension plates 24 each having a pivoting hole 23. The suspension plates 24 are fastened pivotally with the rear inclined frame rod 10 by two pivots 25 which are received in the pivoting holes 23 and the rod holes 13.

A suspension seat rod 26 is provided with an inclined rod 27 corresponding in location to the slot 21 of the front inclined frame rod 19. The inclined rod 27 is provided with a pivoting hole 28 and is fastened pivotally with the front inclined frame rod 19 by a pivot 1 which is received in the pivoting hole 28 and the support holes 22. The inclined rod 27 is further provided with a slot 5 having a wheel support hole 6 for fastening pivotally a lower pulley 29. A protruded rod 30 is provided with a slot 31. The inclined rod 27 is still further provided with two wheel support plates 7. An upper pulley 32 is fastened pivotally with the wheel support plate 7 by the pivot 1. The suspension seat rod 26 is further provided with at least two seat support slots 33, a support column 34, and two lugs 35 each having at least two swing rod support holes 36.

A seat 37 is provided in the underside thereof with an inverted U-shaped frame rod 38 which is placed on the suspension seat rod 26 and is provided with a bolt 39. The seat 37 is fastened with the suspension seat rod 26 by a fitting member 40. The frame rod 38 is fastened with a handle rod 42 having a grip portion 41.

A swivel rod 43 is provided at the top end thereof with a pivoting hole 44 fastened pivotally with a pair of the swing rod support holes, and at the bottom end thereof with a bracing column 45. The swivel rod 43 is further provided at the front edge thereof with two support plates 8 each having a plurality of rope supporting holes 9.

A pedal 46 is provided at the top end thereof with a pivoting hole 47 fastened pivotally with the support hole 12, two arresting columns 48, and a slot 5 housing a front pulley 49. The pedal 46 is provided at the bottom end thereof with an inverted U-shaped support 50 which is provided respectively at both ends thereof with a pedal plate 51.

An inclined top support rod 52 is provided with a plurality of support holes 4 corresponding in location to the threaded hole 3 of the rear inclined frame rod 10. The inclined top support rod 52 is inserted into the top rod fitting seat 15 and is located by a bolt 2 which is received in the threaded hole 3 and the support holes 4. The inclined top support rod 52 is further provided with an arresting rod 53 and a suspension rod pivoting hole 54.

A suspension frame rod 55 is provided with two support holes 56 opposite in location to each other. The front end of the suspension frame rod 55 is opposite in location to the arresting rod 53 of the inclined top support rod 52. The suspension frame rod 55 is further provided with two bolt support holes 57 for mounting an arresting rod 58 such that the arresting rod 58 is located over the arresting rod 53. The suspension frame rod 55 is further provided in the rear segment thereof with two wheel support plates 7. A rear pulley 59 is mounted pivotally between the wheel support holes 6 of the wheel support plates 7 by the pivot 1. The suspension frame rod 55 is provided in the rear end thereof with two handle support holes 60 opposite in location to each other and is further provided with a front cross stop rod 61 and a rear cross stop rod 62.

A handle 63 is provided at the top end thereof with a pivoting hole 64 and in mounted between the handle support holes 60 by the pivot 1. The handle 63 is further provided with two rope support plates 8 each having two rope support holes 9 opposite in location to each other. The handle 63 is provided with an inverted U-shaped handle support 65 having two handle portions 66 and two cross handle portions 67.

An actuating steel cable 68 is provided at one end thereof with a ring member 69 which is mounted between the rope support holes 9 of the rope support plates 8 of the handle 63 such that the steel cable 68 runs through the rear pulley 59 of the suspension frame rod 55, the upper pulley 32 of the suspension seat rod 26, the front pulley 49 of the pedal rod 46, and the lower pulley 29 of the suspension seat rod 26. The steel cable 68 is provided at another end thereof with a stop body 70, which is retained in the slot 31 of the protruded rod 30. The stop body 70 is provided with two pivoting ring members 71.

A sectioned steel cable 72 is provided at the front end thereof with a ring member 73 which is mounted between the two pivoting ring members 71 of the stop body 70 of the steel cable 68. The sectioned steel cable 72 is further provided at the rear end thereof with a ring member 74 which is fastened pivotally between the rope support holes 9 of the rope support plates 8 of the swivel rod 43.

Figure 4:
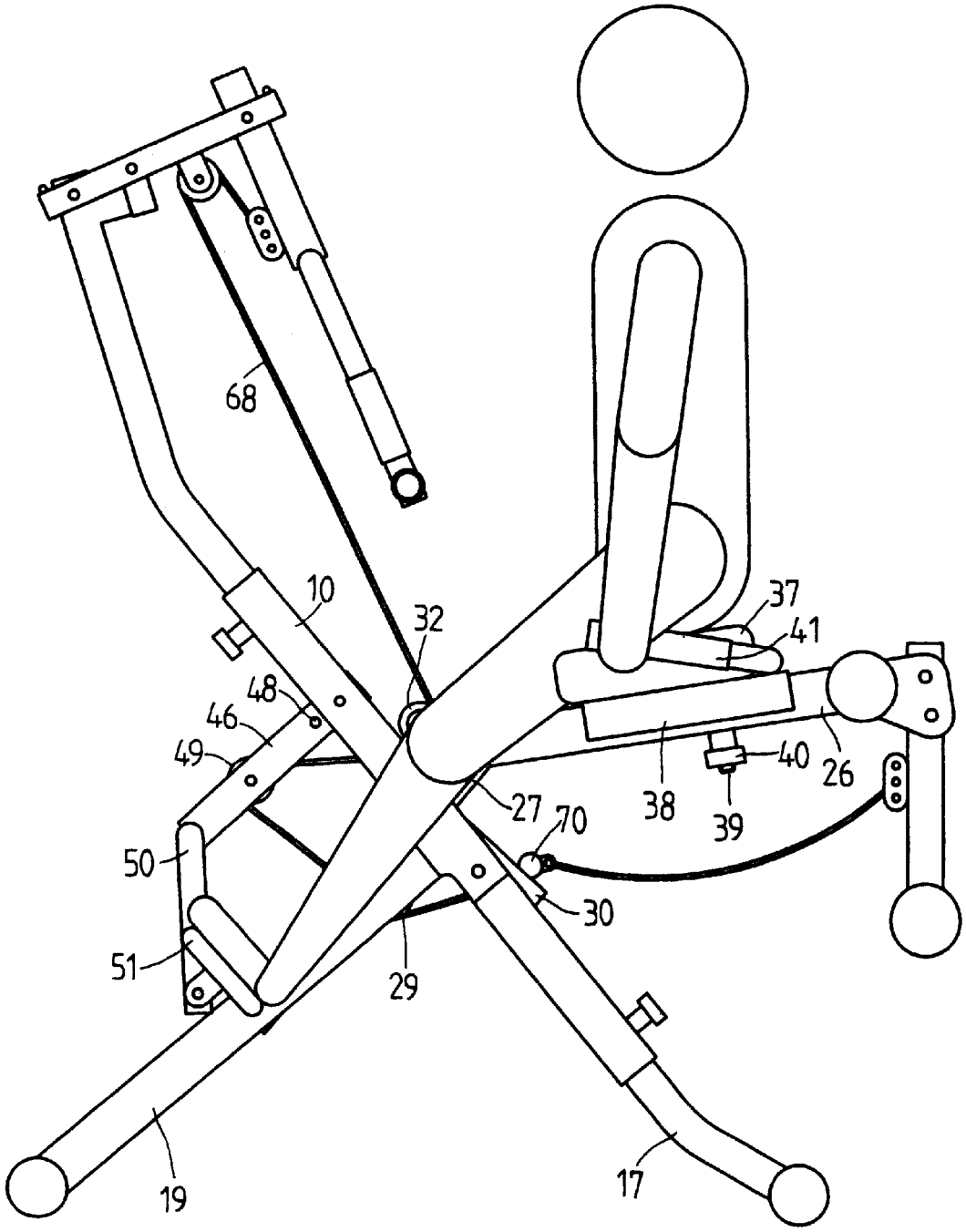
FIGS. 4–7 show schematic views of the present invention at work.
Figure 5:
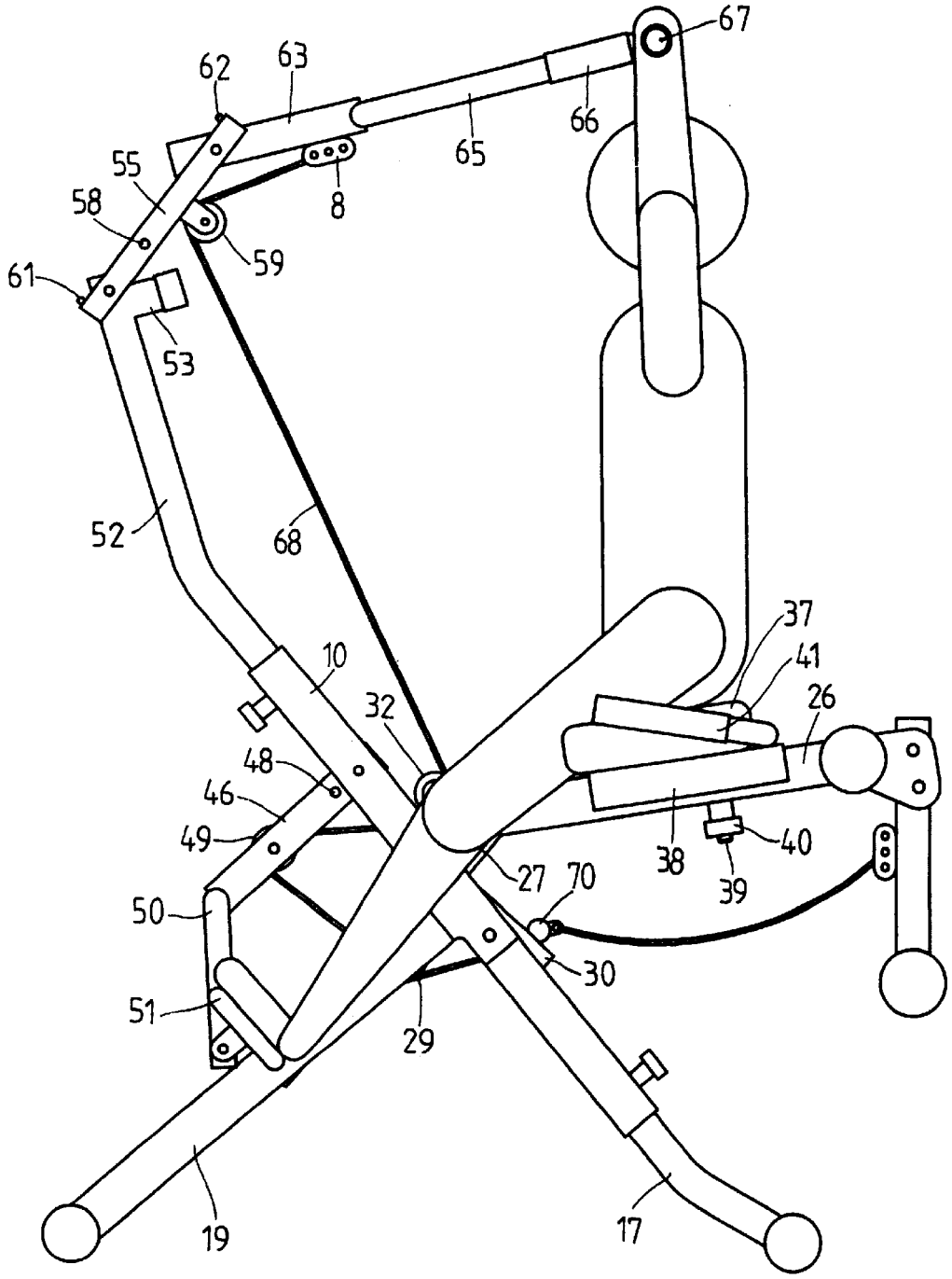
Figure 6:
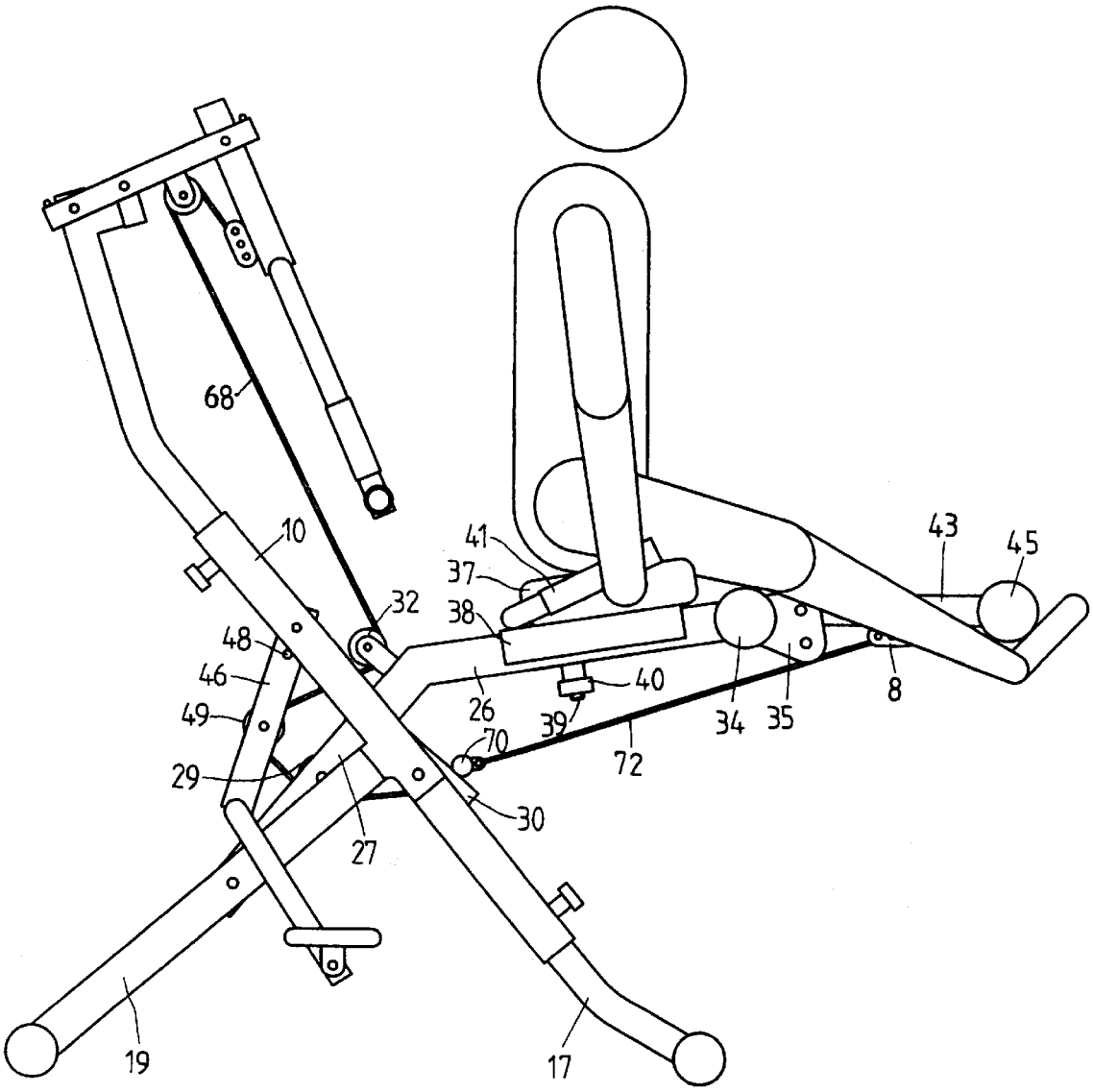
Figure 7:
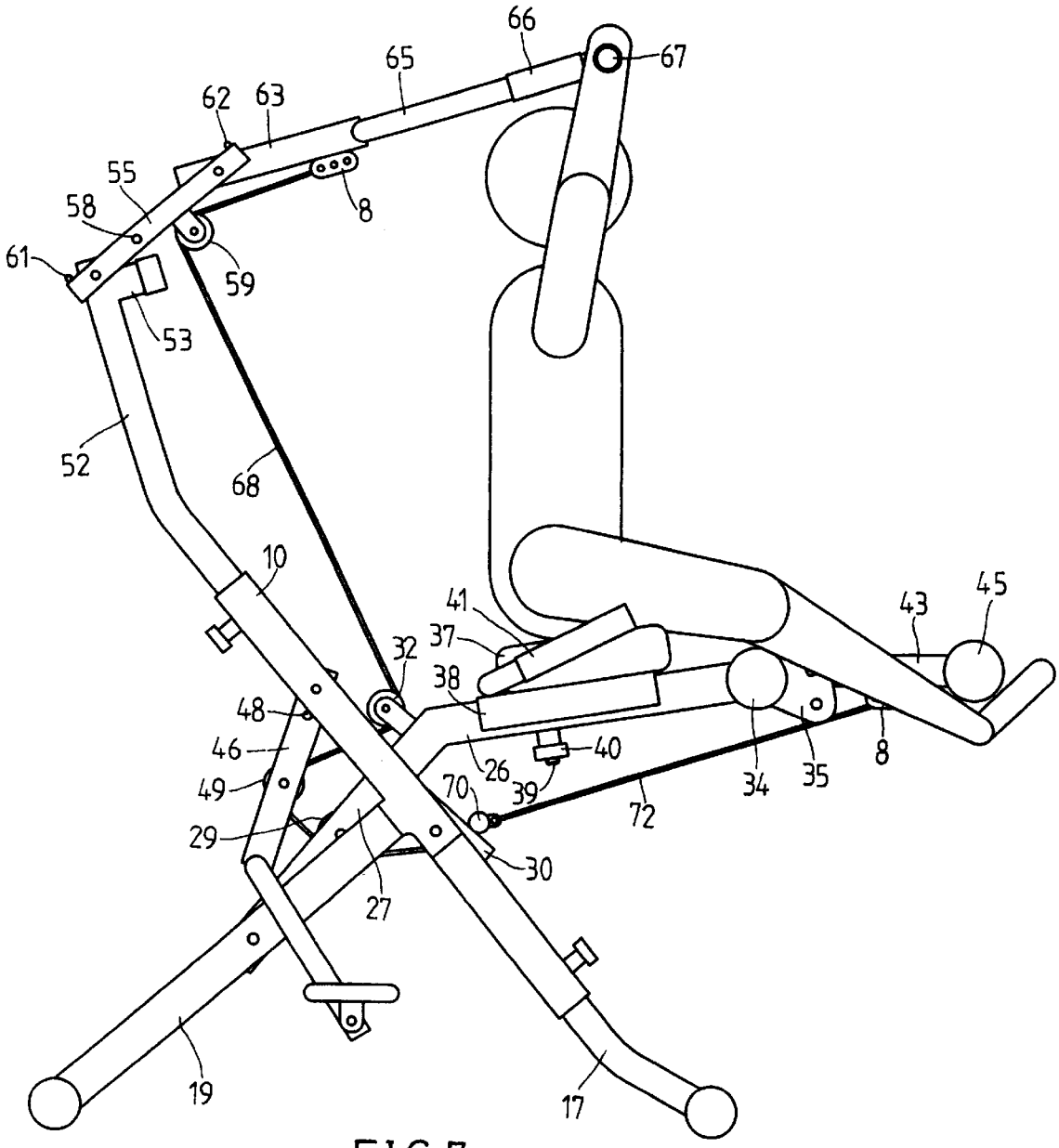
Figure 8:
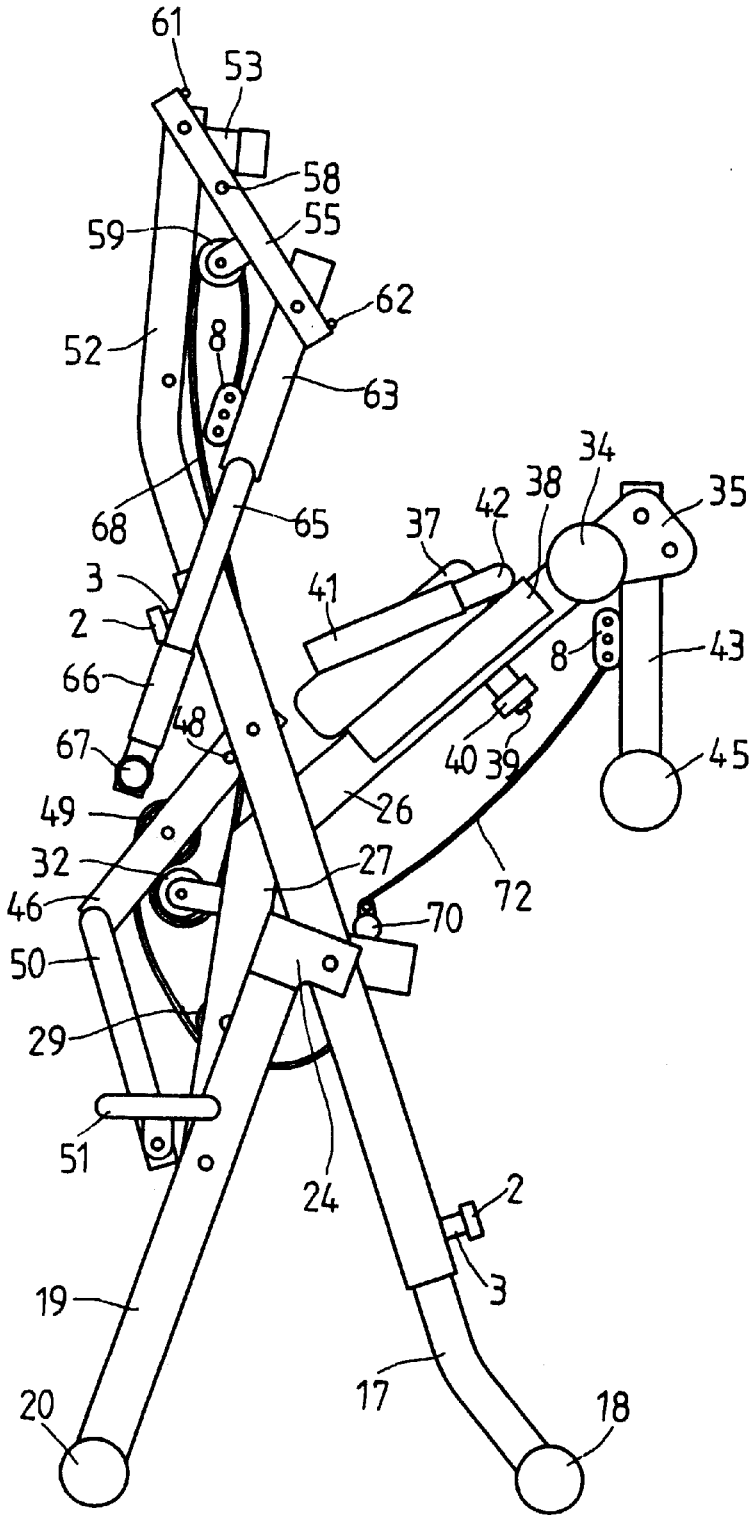
FIG. 8 shows a schematic view of the present invention in the folding state.

FIG. 4 shows the use of the pedal alone. FIG. 5 shows the use of the pedal and handle together. FIG. 6 shows the use of the swivel rod alone. And FIG. 7 shows the use of the swivel rod and handle together. Note that the user sits facing forward to use the pedal and rearward to use the swivel rod. Movement of the pedal, handle or swivel rod raises the seat and user.

As illustrated in FIG. 7, the multifunctional exercise machine is foldable to facilitate storage and shipping.

I claim:

1. A multifunctional exercise machine comprising:

a rear inclined frame rod;

a rear inclined leg rod fastened at a bottom end thereof with a cross rod and at top end thereof with the rear inclined frame rod;

a front inclined frame rod fastened pivotally at a top end thereof with said rear inclined frame rod and fastened at a bottom end thereof with a cross rod;

a suspension seat rod provided with an inclined rod fastened pivotally at one end thereof with said front inclined frame rod, said inclined rod further provided with upper and lower pulleys and a protruded rod, said suspension seat rod further provided with a support column;

a seat located on said suspension seat rod;

a swivel rod fastened pivotally at a top end thereof with the suspension seat rod and fastened at a bottom end thereof with a bracing column;

a pedal fastened pivotally at a top end thereof with said rear inclined frame rod and fastened at a bottom end thereof with a pedal plate, said pedal further provided with a front pulley;

an inclined top support rod fastened with the rear inclined frame rod;

a suspension frame rod fastened pivotally at a front segment thereof with said inclined top support rod, said suspension frame rod further provided with a rear pulley;

a handle fastened pivotally at a top end thereof with a rear segment of said suspension frame rod and provided at a bottom end thereof with handle portions; and an actuating cable fastened at one end to the handle, extending in turn though said rear, upper, front and lower pulleys and fastened at an opposite end to said swivel rod, said cable provided proximate the opposite end thereof with a stop body which is retained in a slot in said protruded rod.

2. The multifunctional exercise machine of claim 1 wherein the suspension seat rod is fastened pivotally within a slot in the front inclined frame rod.

3. The multifunctional exercise machine of claim 1 wherein the actuating cable is fastened to the swivel rod by a sectional cable.

4. The multifunctional exercise machine of claim 1 wherein said rear inclined leg rod is provided with a plurality of support holes corresponding in location to a threaded hole in a leg rod fitting seat on said rear inclined frame rod, said threaded hole being engaged by a bolt.

5. The multifunctional exercise machine of claim 1 wherein said inclined top support rod is provided with a plurality of support holes corresponding in location to a threaded hole in a top rod fitting seat on the rear inclined frame rod, said threaded hole being engaged by a bolt.

6. The multifunctional exercise machine of claim 1 wherein the seat is provided on an underside thereof with an inverted U-shaped frame rod which is located on said suspension seat rod and a bolt which engages a slot in said suspension seat rod and is fastened with a fitting member, said frame rod being provided with a handle having a gripping portion.

7. The multifunctional exercise machine of claim 1 wherein said handle portions are mounted on an inverted U-shaped handle support which is further provided with two cross handle portions.

8. The multifunctional exercise machine of claim 1 wherein said inclined top support rod is provided with a first arresting rod and said suspension frame rod is provided with a second arresting rod located over said first arresting rod.

9. The multifunctional exercise machine of claim 1 wherein said suspension frame rod is further provided with front and rear cross stop rods.

* * * * *